US010138687B2

(12) United States Patent
Taylor et al.

(10) Patent No.: US 10,138,687 B2
(45) Date of Patent: Nov. 27, 2018

(54) SYSTEM AND METHOD FOR PRELOADING CONNECTION USING PRESSURE

(71) Applicant: Schlumberger Technology Corporation, Sugar Land, TX (US)

(72) Inventors: Nicholas Taylor, Rosharon, TX (US); Sammy Deville, Rosharon, TX (US); Timothy Wood, Pearland, TX (US); Jonathan Cruz, Houston, TX (US)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 199 days.

(21) Appl. No.: 15/189,995

(22) Filed: Jun. 22, 2016

(65) Prior Publication Data

US 2017/0370161 A1 Dec. 28, 2017

(51) Int. Cl.

| | |
|---|---|
| ***F16L 37/06*** | (2006.01) |
| ***F16L 37/53*** | (2006.01) |
| ***E21B 17/042*** | (2006.01) |
| ***E21B 33/038*** | (2006.01) |

(52) U.S. Cl.

CPC ..... *E21B 17/042* (2013.01); *E21B 33/038* (2013.01)

(58) Field of Classification Search

CPC ..... Y10T 403/22; Y10T 403/255; Y10T 403/253; Y10T 403/251; F16L 37/06; F16L 37/50; F16L 37/505; F16L 37/53; F16B 1/005

USPC ..... 411/DIG. 3

See application file for complete search history.

(56) References Cited

U.S. PATENT DOCUMENTS

| | | | | |
|---|---|---|---|---|
| 4,124,233 | A * | 11/1978 | Ahlstone | E02D 5/523 285/18 |
| 4,650,225 | A * | 3/1987 | Le | E21B 33/04 285/123.9 |
| 6,554,523 | B2 * | 4/2003 | Aday | F04B 53/147 285/80 |
| 8,727,384 | B2 * | 5/2014 | Stoops | A62C 31/28 285/33 |
| 2009/0014184 | A1 * | 1/2009 | Voss | E21B 33/038 166/345 |
| 2010/0052310 | A1 * | 3/2010 | Stoops | A62C 31/28 285/33 |
| 2011/0187098 | A1 * | 8/2011 | Travis | F16L 23/036 285/405 |
| 2011/0266006 | A1 * | 11/2011 | Lacheny | E21B 33/038 166/379 |
| 2012/0306198 | A1 * | 12/2012 | McDonald Pinedo | F16L 23/032 285/323 |

* cited by examiner

*Primary Examiner* — Kenneth L Thompson
(74) *Attorney, Agent, or Firm* — Brandon S. Clark

(57) ABSTRACT

A technique facilitates formation of a connection between a first component and a second component. The first component and the second component may each comprise a tubular component. Additionally, the second component is secured to the first component via a coupler which is constructed to establish a hydraulic chamber between the coupler and at least one of the first component and the second component. Application of hydraulic pressure in the hydraulic chamber causes a desired preloading of the first component and the second component across the connection.

19 Claims, 3 Drawing Sheets

SYSTEM AND METHOD FOR PRELOADING CONNECTION USING PRESSURE

BACKGROUND

In a variety of well applications, connections between well components are subjected to cyclic loading. In an offshore operation, for example, a landing string may comprise tubular components extending downwardly from a surface rig. Connections between the tubular components are loaded cyclically as the rig moves up and down. Detrimental effects of the cyclic loading can be reduced by placing the connections in tension via application of torque to threaded connectors. The torqued connections are employed to preload the connections in tension. However, torquing of the connection can subject the connection and/or other components to undesirable loads. Additionally, space constraints may sometimes place limitations on the ability to utilize tools for applying the desired torque.

SUMMARY

In general, a system and methodology facilitate formation of a connection between a first component and a second component. The first component and the second component may each comprise a tubular component. Additionally, the second component is secured to the first component via a coupler which is constructed to establish a hydraulic chamber between the coupler and at least one of the first component and the second component. Application of hydraulic pressure in the hydraulic chamber causes a desired preloading of the first component and the second component across the connection.

However, many modifications are possible without materially departing from the teachings of this disclosure. Accordingly, such modifications are intended to be included within the scope of this disclosure as defined in the claims.

BRIEF DESCRIPTION OF THE DRAWINGS

Certain embodiments of the disclosure will hereafter be described with reference to the accompanying drawings, wherein like reference numerals denote like elements. It should be understood, however, that the accompanying figures illustrate the various implementations described herein and are not meant to limit the scope of various technologies described herein, and.

DETAILED DESCRIPTION

Figure 1:
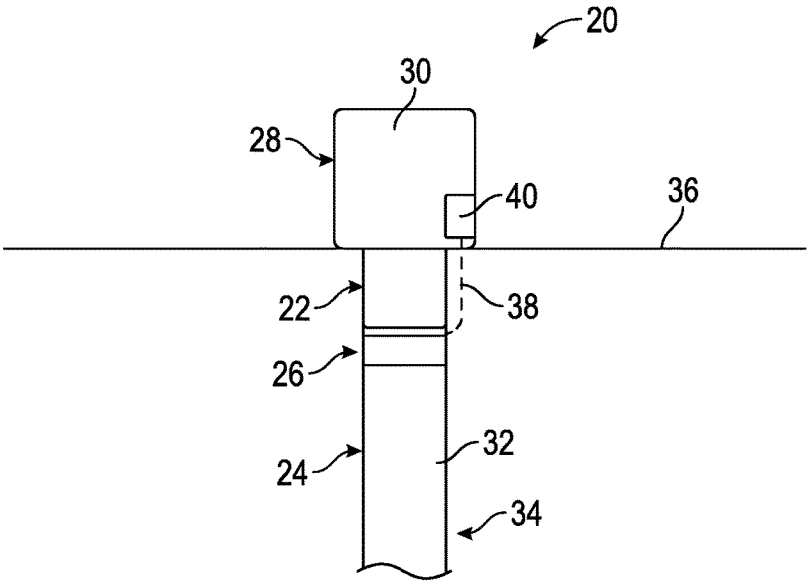
FIG. 1 is a schematic illustration of an example of a landing string having a landing joint coupled to the bottom of a surface flow head via a connection system preloaded in tension under applied pressure, according to an embodiment of the disclosure.

In the following description, numerous details are set forth to provide an understanding of some embodiments of the present disclosure. However, it will be understood by those of ordinary skill in the art that the system and/or methodology may be practiced without these details and that numerous variations or modifications from the described embodiments may be possible.

The present disclosure generally relates to a system and methodology which facilitate coupling of components, e.g. tubular components, with a desired applied loading, e.g. tensile loading. A connection system comprises an assembly which enables application of hydraulic pressure to the connection system after coupling of two mating components. The hydraulic pressure is used to lock the components together under a desired preload without application of high torque to form the coupling.

According to an embodiment, connector ends of two components are mated and then held together by the connection assembly. The connection assembly mechanically secures the components together via, for example, an abutting region and a threaded region. Then, a hydraulic pressure is applied to the connection assembly to prevent the two components from coming apart until separation of the components is desired. By using the hydraulic pressure, the traditional torque connection is eliminated while enabling the desired tension to be applied to the component connection to counter the effects of, for example, cyclic loading on the components. Additionally, use of the hydraulic pressure enables make up of a torque free connection which reduces fatigue hotspots that would otherwise result during torquing to establish the tensile loading.

In some applications, a pressure source may be used to provide a constant hydraulic feed. The constant hydraulic feed ensures the pressure acting on the connection assembly does not vary substantially as tension in the components and connection assembly changes. In other applications, the hydraulic pressure supplied by the pressure source may be capped once the connection is completed and pressurized. For example, the pressure source may have a set volume of hydraulic fluid in a bottle or other container. The latter embodiment enables the connection assembly and pressure source to be freely moved with the components following coupling of the components.

By way of example, the present connection system may be used to place a torque free connection in a landing string of the type which may be employed during an offshore operation. During installation of surface equipment for an offshore operation, e.g. a completion installation, intervention operation, or decompletion operation, a landing joint of a landing string may be coupled to the bottom of surface equipment, e.g. a surface flow head. The landing joint is placed in this position to enable a smooth land out of the completion or to facilitate connection to a tubing hangar on the seabed without damaging equipment.

Because the landing joint is relatively long, the landing joint generally is shipped without being coupled to other equipment and then later coupled to the surface flow head at the offshore rig. Use of the pressure applied connection system described herein avoids formation of a torqued connection which can be difficult to accomplish on a rig. The pressure applied connection system also avoids the generation of high stress concentration hotspots in the connection that can otherwise occur with traditional torqued connection systems.

In general, the system and methodology described herein provide embodiments which facilitate formation of a connection between a first component and a second component. In various applications, the first component and the second component each comprise a tubular component. According to an embodiment, the connection system enables the second component to be secured to the first component via a coupler. The coupler may be constructed to establish a hydraulic chamber between the coupler and at least one of the first component and the second component. Application of hydraulic pressure in the hydraulic chamber causes a desired preloading, e.g. a desired tensile preloading, of the first component and the second component across the connection.

Referring generally to FIG. 1, an example of a well system 20 is illustrated. In this embodiment, a first component 22, e.g. a first tubular component, is joined with a second component 24, e.g. a second tubular component, by a connection system 26. In a specific application, the first component 22 may be part of surface equipment 28 such as a surface flow head 30. In this specific example, the second component 24 may comprise a tubing joint 32 of an overall landing string 34. By way of example, the surface equipment 28 may be located on an offshore facility 36 which may be in the form of a rig, surface vessel, platform, or other suitable offshore facility.

As described in greater detail below, pressurized hydraulic fluid is supplied to the connection system 26 via a flow passage 38 and a pressure source 40. Depending on the application, the pressure source 40 may be positioned in a fixed location at, for example, the surface. In some embodiments, however, the pressure source 40 may be in the form of a pressure bottle or other suitable pressure source which may be moved with connection system 26 while in fluid communication with connection system 26.

Figure 2:
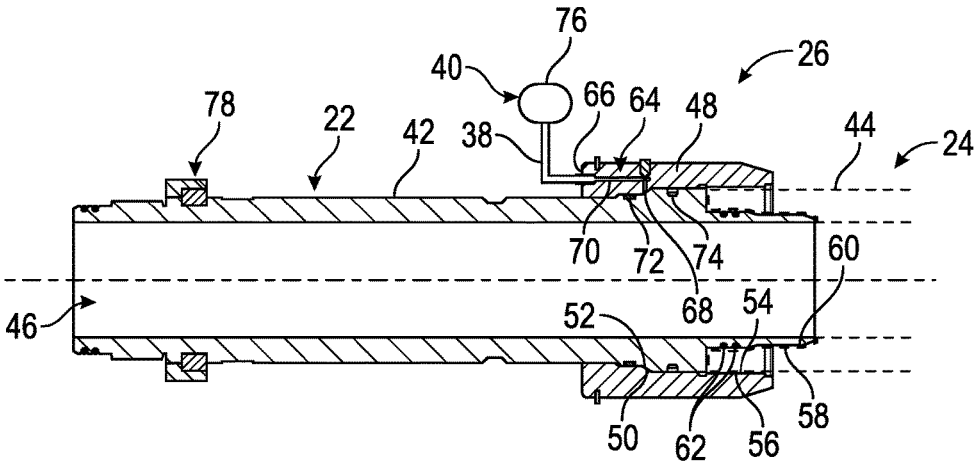
FIG. 2 is a cross-sectional view of an example of a pressure applied connection system, according to an embodiment of the disclosure.

Referring generally to FIG. 2, an embodiment of connection system 26 is illustrated as coupling the first component 22 with the second component 24. In this example, the first component 22 comprises a first tubular component 42 and the second component 24 comprises a second tubular component 44. The tubular components 42, 44 have a hollow interior 46 which may be used for delivering fluid and/or tools therethrough.

In the example illustrated, connection system 26 comprises a coupler 48 which is used to couple the first component 22 and the second component 24. The coupler 48 may be configured to engage the first component 22 and the second component 24 via various mechanisms. In this embodiment, however, the coupler 48 is generally in the form of a ring which may be slid over first component 22 for abutting engagement with an abutment 50 disposed generally along an exterior surface of first component 22, e.g. along first tubular component 42. As illustrated, the coupler 48 may be constructed with a corresponding abutment 52 oriented to engage abutment 50 when the coupler 48 is slid into position along first component 22.

The coupler 48 also may comprise a threaded region 54 oriented for threaded engagement with an externally threaded region 56 disposed along the connection end of second component 24, e.g. second tubular component 44. By rotating coupler 48, threaded region 54 threadably engages the corresponding externally threaded region 56 to initially secure together the first component 22 and the second component 24. Because hydraulic pressure is used to provide the desired tensile loading at connection system 26, the coupler 48 may be used to threadably couple the second component 24 without applying substantial torque loading.

Although the engagement ends of first component 22 and second component 24 may vary depending on the specifics of a given application, the illustrated example shows a male-female connection. As illustrated in FIG. 2, the first tubular component 42 may comprise a male connection end 58 and the second tubular component 44 may comprise a female connection end 60 or vice versa. The connection ends 58, 60 may be slid together and then held together via coupler 48. In some applications, however, the connection ends 58, 60 may be threadably engaged. One or more seals 62 may be positioned to form a suitable seal between connection end 58 and connection end 60.

The coupler 48 is combined with a pressure system 64 having a pressure port 66 disposed along an exterior of the coupler 48. The pressure port 66 is in fluid communication with a hydraulic chamber 68 via a hydraulic flow passage 70 in coupler 48. The hydraulic flow passage 70 may comprise the entire flow line 38 or may be a continuation of flow line 38 depending on the location of pressure source 40 and/or other parameters of a given application.

In the illustrated embodiment, the hydraulic chamber 68 is located between coupler 48 and first component 22. For example, the hydraulic chamber 68 may be positioned radially between an inner surface of the coupler 48 and an exterior surface of the first tubular component 42. The hydraulic chamber 68 is enclosed and sealed on opposite axial sides via a first chamber seal 72 and a second chamber seal 74 which are both disposed between coupler 48 and first component 22.

In this embodiment, the first chamber seal 72 has a different, e.g. smaller, diameter than the second chamber seal 74. The differential between seal diameters ensures that the first component 22 and the second component 24 are drawn toward each other and placed in tension when sufficient pressure is applied in hydraulic chamber 68 via pressure source 40. The chamber seals 72, 74 may be in the form of O-ring seals or other suitable seals able to maintain hydraulic chamber 68.

Effectively, the hydraulic chamber 68 is positioned such that as hydraulic pressure is applied at pressure port 66, the corresponding abutment 52 is pushed away from abutment 50. This causes the second component 24 to be drawn in a direction toward first component 22, thus establishing the desired tensile loading in the components 22, 24. The tensile loading in components 22, 24 may be used to establish a desired preloading at specific locations, e.g. the threaded engagement 54, 56 may be preloaded with a tensile load of a predetermined force via pressure applied in hydraulic chamber 68.

The hydraulic fluid may be supplied under constant pressure from, for example, a surface-based pressure source 40. In other applications, however, the hydraulic fluid may be supplied under pressure from source 40 with a predetermined volume. For example, the hydraulic fluid pressure source 40 may be in the form of a pressure bottle 76 which has a set volume and is charged to a predetermined pressure. The pressure bottle 76 is coupled with port 66 and, at least in some applications, may be moved with connection system 26.

Depending on the application, the first component 22 and second component 24 may comprise various other structures 78. In the embodiment shown, such a structure 78 is illustrated as positioned along an exterior of first tubular component 42. By way of example, the structure or structures 78 may comprise component handling fixtures, cable routing brackets, sensors, and/or other structures appropriate for a given operation.

Figure 3:
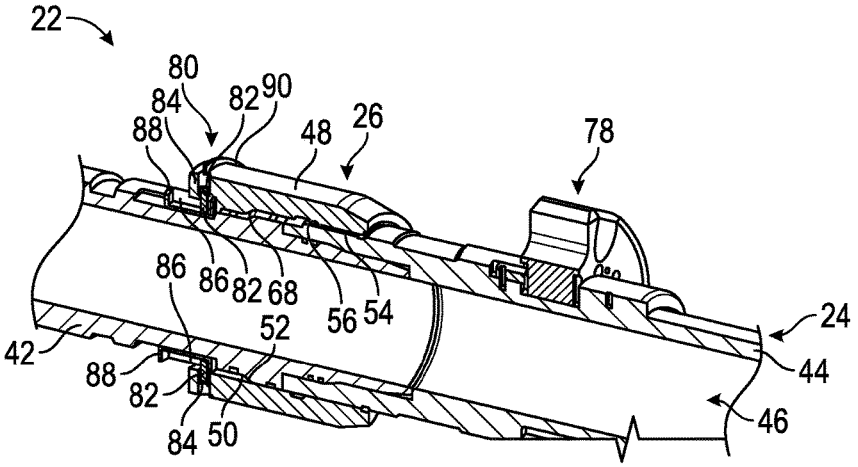
FIG. 3 is a cross-sectional view of another example of a pressure applied connection system, according to an embodiment of the disclosure.

Referring generally to FIG. 3, another embodiment of connection system 26 is illustrated. In this embodiment, the connection system 26 further comprises an anti-rotation system 80 which may be used to prevent unwanted rotation of coupler 48 once the first component 22 and second component 24 are engaged by coupler 48. For example, the coupler 48 may be threaded into engagement with threaded region 56 of second tubular component 44 and then the anti-rotation system 80 may be set to prevent unwanted loosening of threaded regions 54, 56.

The anti-rotation system 80 may comprise various features, but the illustrated embodiment utilizes at least one pin 82, e.g. a plurality of pins 82. The pins 82 are inserted through corresponding radial holes 84, formed through coupler 48, and into engagement with pin slots 86 formed in pin receiver brackets 88. The pin slots 86 allow axial movement of coupler 48 when hydraulic chamber 68 is pressurized or depressurized. However, the pin slots 86 trap the pins 82 rotationally so as to prevent unwanted rotation of the coupler 48 with respect to first component 22 and/or second component 24.

As illustrated, the pin receiver brackets 88 may be mounted along an exterior of first component 22. Depending on the application, the pin receiver brackets 88 may be a unitary part of first component 22 or the brackets 88 may be secured to first component 22 by suitable fasteners, e.g. threaded fasteners, weldments, or adhesive. The pins 82 may be in the form of threaded pins which are threaded through the corresponding radial holes 84 and into engagement with pin slots 86. However, the pins 82 also may sized for linear insertion through the corresponding radial holes 84. A removable retainer ring 90 or other suitable retainer may be used to secure the pins 82 in engagement with pin slots 86.

Figure 4:
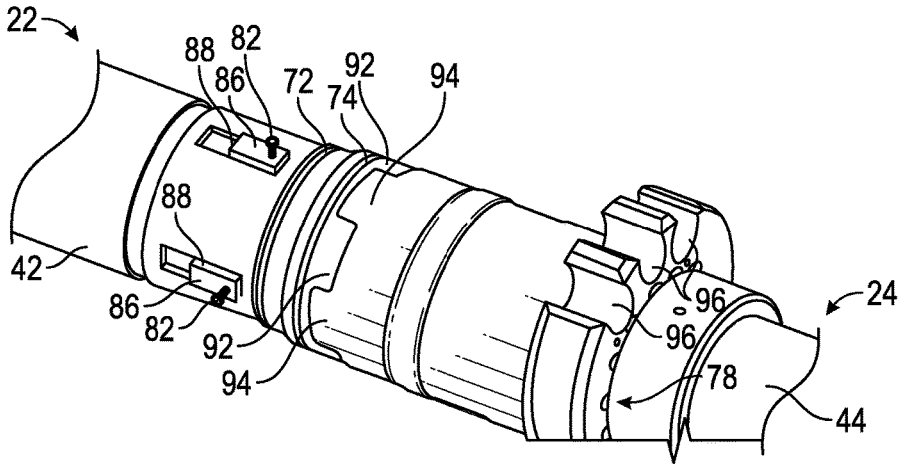
FIG. 4 is an illustration of a connection between two tubular components with which the pressure applied connection system may be combined, according to an embodiment of the disclosure.

The connection system 26 also may comprise other features such as anti-rotational features between the first component 22 and the second component 24, as illustrated in FIG. 4. In this example, the components 22, 24 comprise first tubular component 42 and second tubular component 44 which have castellations 92, 94, respectively. When the second tubular component 44 is moved linearly into engagement with first tubular component 42, the castellations 92, 94 engage each other to prevent relative rotation between first tubular component 42 and second tubular component 44.

Figure 5:
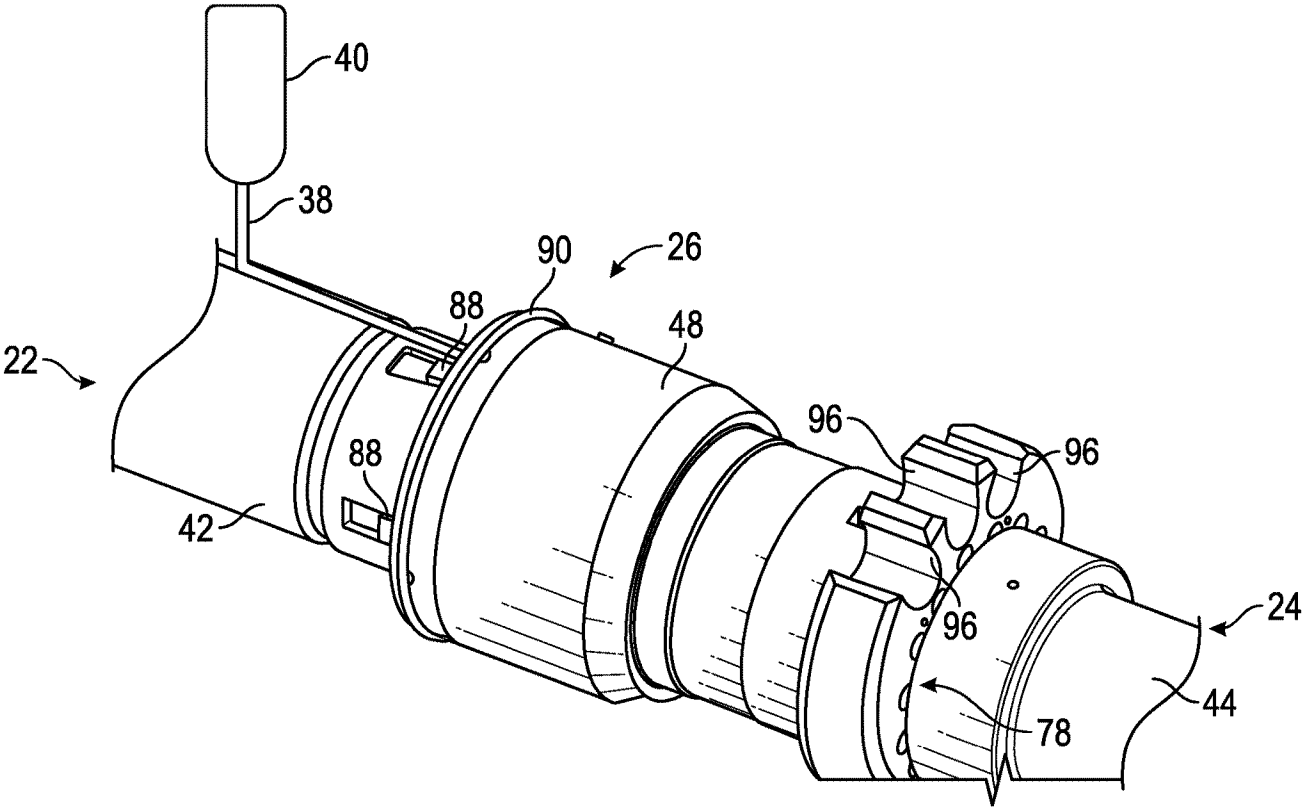
FIG. 5 is an external orthogonal view of the pressure applied connection system illustrated in FIG. 3, according to an embodiment of the disclosure.

It should be noted FIG. 4 illustrates the engaged tubular components 42, 44 without coupler 48 so as to clearly show the engaged castellations 92, 94. As illustrated in FIG. 5, installation of coupler 48 effectively covers the castellations 92, 94 once the coupler 48 is threadably engaged with the second tubular element 44. The hydraulic pressure source 40 may then be coupled to port 66 via flow line 38, as further illustrated in FIG. 5.

FIGS. 4 and 5 provide an example of structure 78 in the form of a control line bracket. The control line bracket has a series of slots 96 for receiving control lines or other components along the exterior of the tubular components 42, 44. However, numerous types of structures 78 may be combined with one or more of the tubular components 42, 44.

Depending on the parameters of a given application and/or environment, the structure of well system 20 may vary. Additionally, the connection system 26 may be used for joining many types of tubular components or other components in well related or non-well related applications. The connection system 26 facilitates formation of connections between components without torquing the components or with reduced torquing of the components. Furthermore, the connection system 26 facilitates placement of a desired preload, e.g. a tensile preload, along the connected components via application of hydraulic pressure rather than through use of torquing tools.

The size and structure of the connection system 26 and coupler 48 may be adjusted according to the parameters of a given application. Additionally, the size, location, and configuration of the hydraulic chamber as well as the cooperating seals may be selected according to equipment and/or environmental parameters. The abutments, threaded regions, and/or anti-rotation features also may be reversed or changed in configuration to accommodate a given application. Similarly, various types of pressure sources may be used to supply desired amounts of pressurized hydraulic fluid at selected pressures sufficient to establish the desired loading. The hydraulic pressure may be a constantly applied hydraulic pressure or a changing hydraulic pressure due to, for example, a set volume of the hydraulic fluid available in the hydraulic pressure source. The connected components also may have various shapes and sizes for use in many types of operations.

Although a few embodiments of the disclosure have been described in detail above, those of ordinary skill in the art will readily appreciate that many modifications are possible without materially departing from the teachings of this disclosure. Accordingly, such modifications are intended to be included within the scope of this disclosure as defined in the claims.

What is claimed is:

1. A system for coupling components, comprising:

a first tubular component;

a second tubular component linearly engaging the first tubular component in an interlocking manner by way of castellations of the components to prevent rotation between the components;

a coupler placed in abutting engagement with the first tubular component and threaded engagement with the second tubular component; and a pressure system comprising a pressure port on an exterior of the coupler, the pressure port being in fluid communication with a hydraulic chamber between the coupler and the first tubular component, the hydraulic chamber being positioned such that hydraulic pressure applied at the pressure port causes the coupler to draw the second tubular component in a direction toward the first tubular component and to establish a desired tensile loading on the first tubular component and the second tubular component.

2. The system as recited in claim 1, wherein the second tubular component comprises a tubing joint of a landing string.

3. The system as recited in claim 1, wherein the hydraulic chamber is sealed along the first tubular component and the coupler by a pair of O-ring seals having differing diameters with respect to each other.

4. The system as recited in claim 1, wherein the pressure port is coupled with a pressure source.

5. The system as recited in claim 1, wherein the pressure port is coupled with a pressure source supplying a constant pressure.

6. The system as recited in claim 1, wherein the pressure port is coupled with a pressure source in the form of a pressure bottle having a limited volume of pressurized hydraulic fluid to apply the pressure at the pressure port.

7. The system as recited in claim 2, wherein the first tubular component extends from a surface flowhead of an offshore well installation.

8. The system as recited in claim 1, wherein the coupler is engaged by at least one pin which extends into a corresponding pin channel to allow axial movement while preventing rotational movement of the coupler relative to the first tubular member.

9. A system, comprising:

a first connector component linearly engaged with a second connector component;

a coupler securing engagement between the first connector component and a second connector component, the coupler having at least one pin extending into a pin channel thereof to allow axial movement while preventing rotational movement of the coupler relative to the first tubular member and the coupler forming a hydraulic chamber between the first connector component and an interior surface of the coupler; and a pressure source in fluid communication with the hydraulic chamber, the pressure source supplying pressurized hydraulic fluid to the hydraulic chamber to force the second connector component toward the first connector component.

10. The system as recited in claim 9, wherein the first connector component is prevented from rotating with respect to the second connector component by a plurality of castellations.

11. The system as recited in claim 9, wherein the hydraulic chamber is in fluid communication with a flow passage extending through the coupler to a pressure port.

12. The system as recited in claim 9, wherein the first connector component and the second connector component are tubular components.

13. The system as recited in claim 12, wherein the coupler is in abutting engagement with a portion of the first connector component and threaded engagement with the second connector component.

14. The system as recited in claim 13, wherein the second connector component is a tubing joint of a landing string.

15. The system as recited in claim 14, wherein the hydraulic chamber is sealed by seals having different diameters relative to each other such that application of pressure in the hydraulic chamber establishes a tensile loading on the first connector component and the second connector component.

16. A method, comprising:

forming a rotationally interlocked connection between a first tubular component and a second tubular component;

securing the second tubular component to the first tubular component via a coupler;

providing a hydraulic chamber within the coupler; and positioning the hydraulic chamber such that application of hydraulic pressure from a predetermined hydraulic volume source to the hydraulic chamber establishes a desired preloading of the first tubular component and the second tubular component across a connection.

17. The method as recited in claim 16, wherein the application of hydraulic pressure via the hydraulic volume source is facilitated through a pressure port on the coupler.

18. The method as recited in claim 17, wherein the application of hydraulic pressure comprises using a pressure bottle.

19. The method as recited in claim 16, wherein securing comprises engaging the coupler with the first tubular component via abutment and with the second tubular component via threaded engagement.

* * * * *